US006409569B1

(12) United States Patent
Boone

(10) Patent No.: US 6,409,569 B1
(45) Date of Patent: Jun. 25, 2002

(54) CONTAINER FOR LIQUID DISSOLVABLE CAPSULES CONTAINING COMPRESSED, EXPANDABLE TOY FIGURES

(76) Inventor: Stephen D. Boone, 4804 Strawberry La., Louisville, KY (US) 40209-1243

( * ) Notice: Subject to any disclaimer, the term of this patent is extended or adjusted under 35 U.S.C. 154(b) by 0 days.

(21) Appl. No.: 09/825,424

(22) Filed: Apr. 3, 2001

(51) Int. Cl.[7] ..... A63H 3/00

(52) U.S. Cl. ..... 446/74; 40/409; 206/5; 428/14

(58) Field of Search ..... 53/474; 40/409; 206/5, 77.1, 461; 428/14; 446/73–75, 153

(56) References Cited

U.S. PATENT DOCUMENTS 2,887,824 A * 5/1959 Riva ..... 206/461
4,881,915 A * 11/1989 Liaw ..... 446/153
5,183,429 A * 2/1993 Bitton ..... 446/73
5,273,476 A * 12/1993 Dorfman ..... 446/73
5,316,689 A * 5/1994 Farrell ..... 446/153
5,350,058 A * 9/1994 Keough ..... 446/75
5,404,731 A * 4/1995 Traub ..... 446/153
5,768,917 A * 6/1998 Freida ..... 206/5
5,839,842 A * 11/1998 Wanat et al. ..... 206/77.1
5,887,410 A * 3/1999 Lowenthal ..... 53/474

* cited by examiner

*Primary Examiner*—Jim Foster
(74) *Attorney, Agent, or Firm*—Maurice L. Miller, Jr.

(57) ABSTRACT

A combination including a container having a back plate and a transparent receptacle secured to the back plate, and one or more liquid dissolvable capsules containing compressed, resiliently expandable toy figurines confined in a chamber between the receptacle and the back plate is disclosed. One or more openings are formed in the back plate which communicate with the chamber between the receptacle and back plate so that warm water can flow into the chamber to dissolve the capsules to release the toy figurines upon immersion of the container in a warm liquid such as a child's bath water, the container thus preventing young children from handling the capsules directly.

10 Claims, 2 Drawing Sheets

CONTAINER FOR LIQUID DISSOLVABLE CAPSULES CONTAINING COMPRESSED, EXPANDABLE TOY FIGURES

BACKGROUND OF THE INVENTION

The invention relates to a container having a transparent receptacle containing one or more liquid dissolvable gelatin capsules containing compressed, resiliently expandable toy figurines or characters, the receptacle being mounted on a back plate containing openings which communicate with the interior of the receptacle for permitting a warm liquid, such as a child's bath water, to enter the receptacle to dissolve the gelatin capsules when the container is immersed in the bath water.

Liquid dissolvable capsules of the aforementioned type are well known in the prior art and are in wide use as novelty items, primarily for the entertainment of small children. Such capsules can be cast into a child's warm bath water, whereupon they dissolve to release a highly compressed, resiliently expandable foam character or figurine depicting a zoo animal, vehicle, statue, geographic area, cartoon character or other article attractive to children. Upon release from the capsule, the foam character will typically expand to several times the size of the capsule itself.

A difficulty that has been encountered with such capsules is that they are typically of a size that can readily be swallowed by a young child. Under such circumstances the child's internal temperature is usually more than sufficient to cause the capsule to dissolve to release the expandable figurine.

By means of my invention, these and other difficulties encountered in the use of such capsules are substantially eliminated.

SUMMARY OF THE INVENTION

It is an object of my invention to provide a container for housing liquid dissolvable capsules containing compressed, resiliently expandable foam figurines, the container having a transparent receptacle for the capsules into which a warm liquid can seep when the container is immersed in the liquid to cause the capsules to dissolve to permit the figurines to be released while preventing direct handling of the capsules as, for example, by young children Briefly, in accordance with my invention, there is provided, in combination with at least one liquid dissolvable capsule containing a compressed, resiliently expandable toy figurine, a container for the capsule. The container comprises a flat back plate and a receptacle which is at least partially transparent attached to and projecting outwardly from the plate. The capsule is confined in a closed hollow chamber formed between the receptacle and the back plate. The back plate defines at least one opening which communicates with the chamber for permitting a quantity of a liquid to flow into the chamber to dissolve the capsule upon immersion of the container in the liquid. The opening or openings each have dimensions which are less than that of the capsule to prevent the capsule from being removed from the chamber through any one opening.

These and other objects, features and advantages of the present invention will become apparent to those skilled in the art from the following detailed description and attached drawings upon which, by the way of example, only a preferred embodiment of my invention is illustrated.

DESCRIPTION OF THE PREFERRED EMBODIMENT

Referring now to the accompanying drawings, there is shown, in a preferred embodiment of my invention, a container 10 for containing one or more capsules 12. The capsules 12 are dissolvable in a warm liquid such as water and each contains a tightly compressed, resiliently expandable figurine such as a comic character, animal figure or other artistic representation, preferably of interest to children. The liquid dissolvable capsules 12 are conventional and the compressed, expandable figurines contained therein are preferably made of a conventional expandable resilient plastic foam material such as polyurethane or other suitable material well known for use in such a manner.

Figure 1:
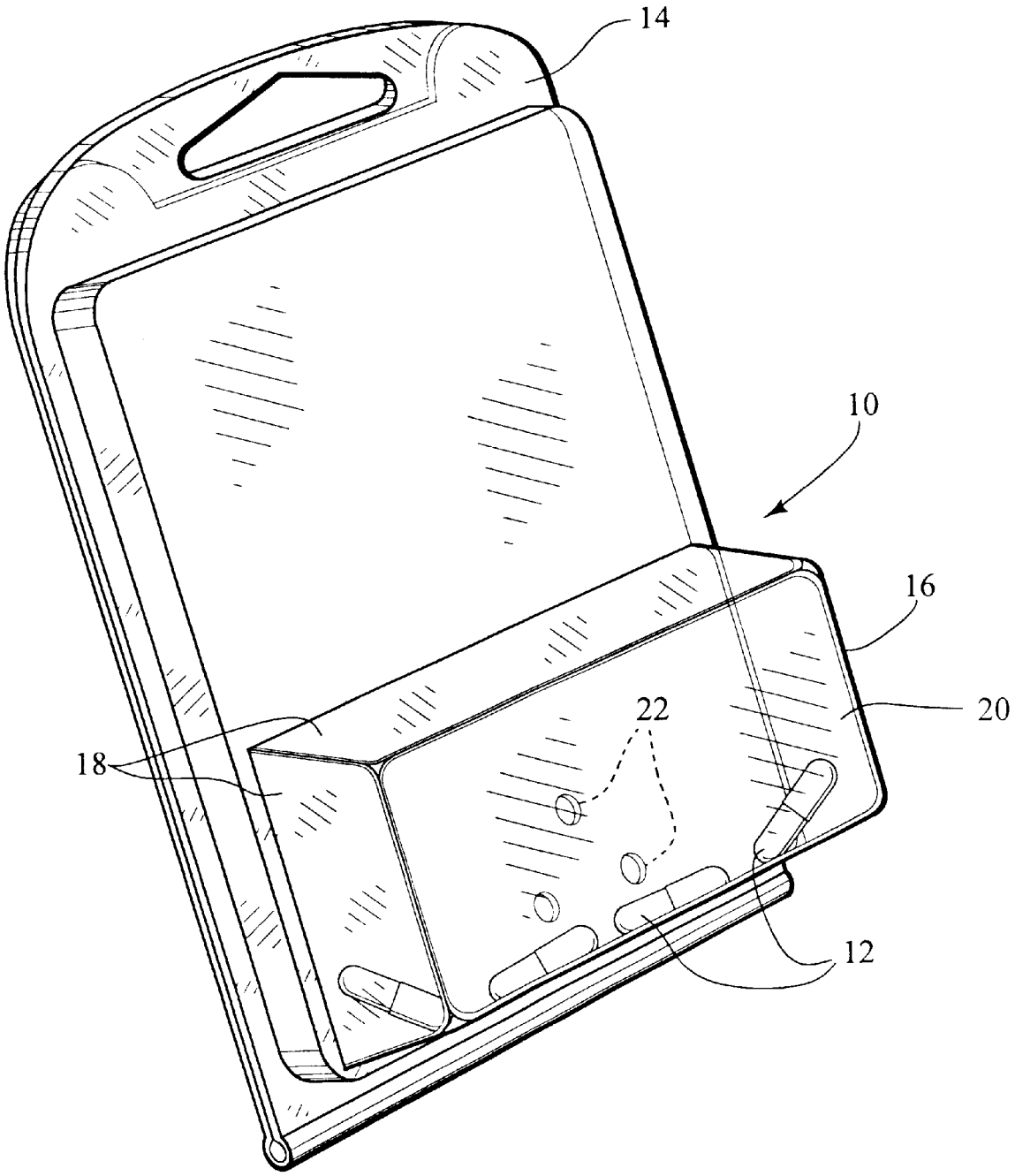
FIG. 1 shows a perspective view of a container containing encapsulated expandable foam toy figures, thus illustrating a preferred embodiment of my invention.
Figure 3:
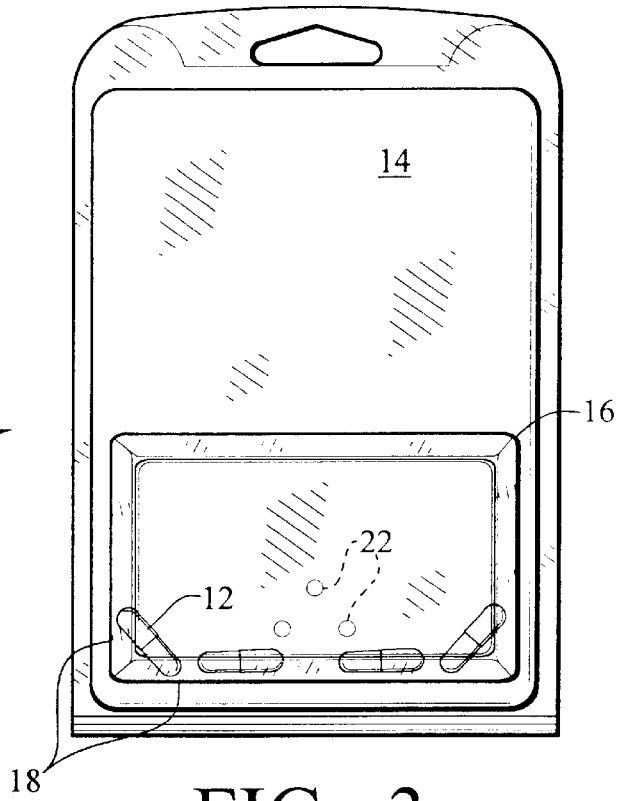
FIG. 3 shows a front elevation view of the container of FIGS. 1–2.
Figure 4:
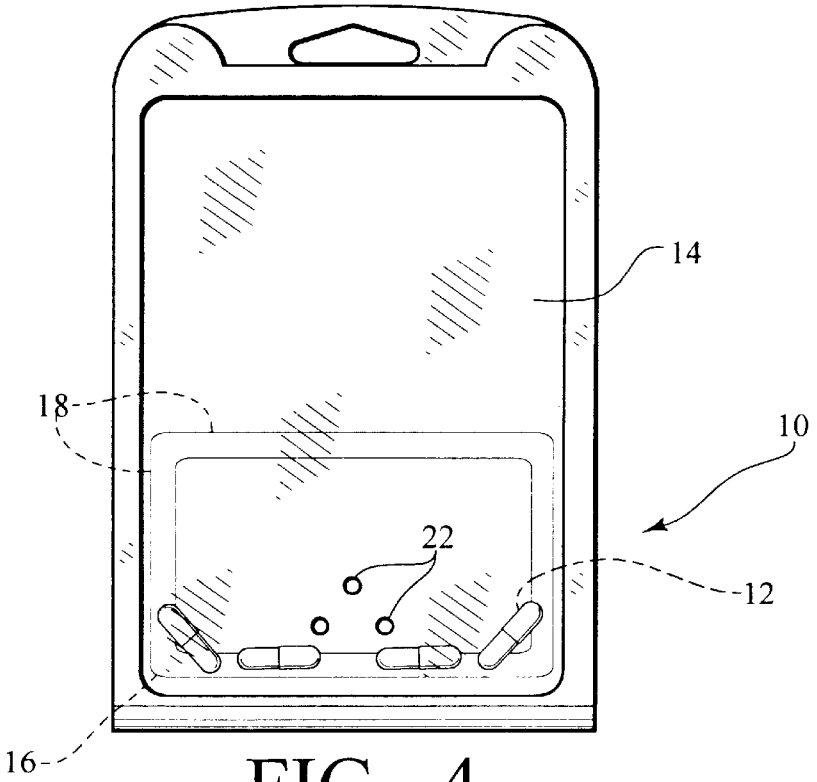
FIG. 4 shows a rear elevation view of the container of FIGS. 1–3.

The container 10 includes a flat back plate 14 and a transparent receptacle 16 attached to and projecting outwardly from a broad surface of the back plate. The back plate 14 and receptacle 16 are, preferably, constructed of plastic and, while both may be transparent, only the receptacle 16 need be transparent. The receptacle 16 of the present embodiment is rectangularly shaped as viewed in plan, such as shown in FIGS. 1 and 3, and includes four sides 18 and a broad front face 20. The back plate 14 forms a backing for the receptacle 16 and a base edge of each of the sides 18 may be heat or sonically sealed to the back plate in any well known manner.

The back plate 14 of the present example defines three spaced apart openings 22 which communicate with an interior chamber of the receptacle 16. The capsules 12 are disposed within an interior chamber of the receptacle 16. The diameter of each of the openings 22 should be less than the diameter of each of the capsules 12 to prevent the capsules from being removed from the receptacle 16 through any one of the openings. The capsules 12 should be dissolvable in a liquid such as water at a temperature approximately equal to human body temperature and higher. Examples of such capsules 12 containing expandable foam figurines of particular interest to children are distributed in the United States by Instant Products, Inc., 4804 Strawberry Lane, Louisville, Ky. 40209. A series of such capsules 12, each of which preferably contains a different figure, character or animal representation, are placed in the receptacle 16 and base edges of the receptacle are then heat or sonically sealed against a broad surface of the back plate 14. Accordingly, the capsules 12 should be irremovably confined within a hollow chamber between the receptacle and the back plate 14 so as to prevent them from being handled by a child.

Figure 2:
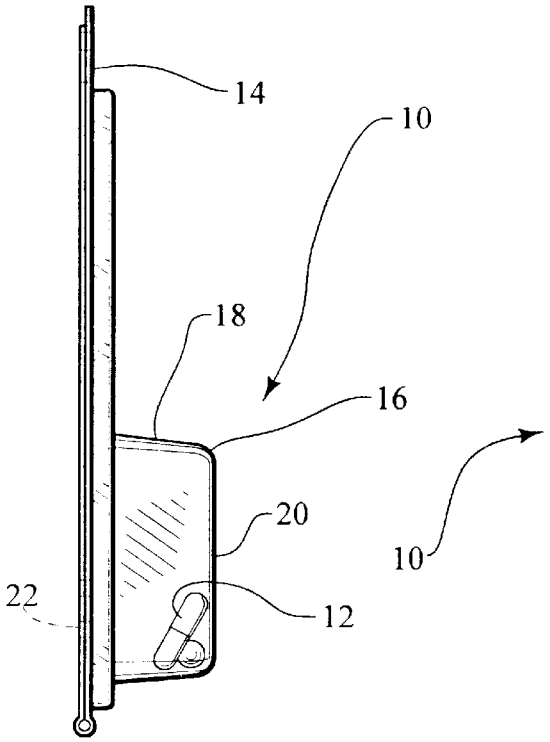
FIG. 2 shows a side elevation view of the container of FIG. 1.

I prefer to mold the back plate 14 from plastic, clamshell style, wherein two interlocking rectangularly shaped plates are integrally joined by a transversely extending live hinge joint. The two plates so joined are formed in a mold such that the plates lie in a single plane. After the molding operation is complete the two plates can be folded against one another about the live hinge. See the cylindrically shaped live hinge at the base of the back plate 14 in FIGS. 1–2.

In typical use, the container 10 containing one or more of the capsules 12, can be immersed in warm water such as, for example, a child's bath water, sufficient to permit water to seep into the receptacle 16 through the openings 22 in the back plate 14. The warm water within the receptacle 16 will then dissolve the capsules 12 to release the compressed toy figurines, which figurines expand rapidly as they are released from confinement to form comic characters, animal figurines, and the like which can be viewed through the face 20 of the receptacle, all to the delight of the viewer, especially children. Moreover, because the capsules 12 are completely enclosed within the receptacle 16, they cannot be handled and, perhaps, swallowed by small children.

The only requirement for the one or more openings in the back plate 14 is that it or they be sufficient to permit a liquid to flow into the receptacle 16 when the container 10 is immersed in the liquid and that the dimensions of each opening be restricted such that one or more capsules 12 contained in the receptacle 16 can not be removed through the opening. As long as these requirements are met, then it does not matter how many openings are employed and may even be as few openings as one. Also, the openings need not be circular but could be in the form of one or more elongated linear or arc shaped slots, rectangles, or other geometric shapes.

Although the present invention has been shown and described with respect to specific details of a certain preferred embodiment thereof, it is not intended that such details limit the scope and coverage of this patent other than as specifically set forth in the following claims.

I claim:

1. In combination with at least one liquid dissolvable capsule containing a compressed, resiliently expandable toy figurine, a container for said, capsule comprising a flat back plate; and a receptacle being at least partially transparent for permitting a user to view the interior thereof, said receptacle being attached to and projecting outwardly from said plate, said capsule being confined in a closed hollow chamber formed between said receptacle, and said back plate, said plate defining at least one opening which communicates with said chamber for permitting a quantity of a liquid to flow into said chamber to dissolve said capsule upon immersion of said container in said liquid, said at least one opening having dimensions such that said capsule is prevented from being removed from said chamber therethrough.

2. The combination of claim 1 wherein said receptacle is constructed of plastic.

3. The combination of claim 1 wherein said back plate and receptacle are constructed of plastic.

4. The combination of claim 1 wherein said at least one opening comprises a plurality of said openings.

5. The combination of claim 1 wherein said receptacle is rectangularly shaped and contains four sides and a front face, base edges of said sides being attached to said back plate so as to form said chamber between said receptacle and back plate in which said capsule is confined.

6. The combination of claim 3 wherein said back plate comprises two plates joined together clamshell style.

7. The combination of claim 3 wherein said backplate comprises two plates integrally joined together along a single common side by a live hinge, said two plates being folded against one another about said live hinge.

8. The combination of claim 4 wherein said plurality is three.

9. The combination of claim 5 wherein said back plate is rectangularly shaped and contains length and width dimensions greater than corresponding length and width dimensions, respectively, of said receptacle.

10. The combination of claim 1 wherein said at least one capsule comprises a plurality of capsules.

* * * * *